US009956770B2

(12) United States Patent
Kodaira et al.

(10) Patent No.: US 9,956,770 B2
(45) Date of Patent: May 1, 2018

(54) DROPLET DETECTION DEVICE AND INK JET PRINTER

(71) Applicant: MIMAKI ENGINEERING CO., LTD., Nagano (JP)

(72) Inventors: Masaki Kodaira, Nagano (JP); Akihiko Mizusaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/541,710

(22) PCT Filed: Jan. 7, 2016

(86) PCT No.: PCT/JP2016/050328

§ 371 (c)(1),
(2) Date: Jul. 6, 2017

(87) PCT Pub. No.: WO2016/111325

PCT Pub. Date: Jul. 14, 2016

(65) Prior Publication Data

US 2018/0022090 A1 Jan. 25, 2018

(30) Foreign Application Priority Data

Jan. 7, 2015 (JP) ..... 2015-001912

(51) Int. Cl.
*B41J 2/045* (2006.01)
*B41J 2/21* (2006.01)

(52) U.S. Cl.
CPC ..... *B41J 2/04561* (2013.01); *B41J 2/04586* (2013.01); *B41J 2/2142* (2013.01)

(58) Field of Classification Search
CPC .... B41J 29/393; B41J 2/0451; B41J 2/04561; B41J 2/2142; B41J 2/04586; B41J 2/165; B41J 29/38; B41J 2/07; G01F 23/2922; G01N 21/84
See application file for complete search history.

(56) References Cited

U.S. PATENT DOCUMENTS 9,132,629 B2 * 9/2015 Ward ..... B41J 2/0451

FOREIGN PATENT DOCUMENTS

JP 2009502572 1/2009

OTHER PUBLICATIONS

"International Search Report (Form PCT/ISA/210) of PCT/JP2016/050328", dated Mar. 15, 2016, with English translation thereof, pp. 1-4.

* cited by examiner

*Primary Examiner* — Thinh H Nguyen
(74) *Attorney, Agent, or Firm* — JCIPRNET

(57) ABSTRACT

A droplet detection device includes a light emitting element that emits a detection light for detecting shielding of at least one part by a microdroplet discharged from a nozzle of a head of an ink jet printer in a direction intersecting an advancing direction of the microdroplet; a light receiving element; and a pair of wall portions facing each other and enabling the microdoplet to pass therebetween; where the wall portions have one part of a light path of the detection light from the light emitting element to the light receiving element and allows at least one part of the detection light to be reflected and to reach the light receiving element, and the detection light has a width in a direction equal to a spacing in the direction of the wall portions in a region sandwiched by ends on the light emitting element side of the wall portions.

16 Claims, 11 Drawing Sheets

DROPLET DETECTION DEVICE AND INK JET PRINTER

CROSS-REFERENCE TO RELATED APPLICATION

This application is a 371 application of the International PCT application serial no. PCT/JP2016/050328, filed on Jan. 7, 2016, which claims the priority benefits of Japan Patent Application No. 2015-001912, filed on Jan. 7, 2015. The entirety of each of the above-mentioned patent applications is hereby incorporated by references herein and made a part of this specification.

TECHNICAL FIELD

The present invention relates to a droplet detection device that detects a microdroplet discharged from a nozzle of a head of an ink jet printer, and an ink jet printer equipped with the droplet detection device.

BACKGROUND ART

A device including a collimating light source is conventionally known for the droplet detection device that detects a microdroplet discharged from a nozzle of a head of an ink jet printer (see e.g., Patent Literature 1).

CITATION LIST

Patent Literature

Patent Literature 1: Japanese Unexamined Patent Publication (Translation of PCT Application) No. 2009-502572

SUMMARY OF INVENTION

Technical Problems

However, the collimating light source needs to use an expensive device such as a laser, and the like. Therefore, the conventional droplet detection device has a problem in that the manufacturing cost is high.

The present invention thus provides a droplet detection device and an ink jet printer capable of keeping the manufacturing cost low compared to the conventional art.

Solutions to the Problems

The present invention relates to a droplet detection device that detects a droplet (microdroplet) discharged from a nozzle of a head of an ink jet printer based on presence or absence of shielding of a detection light by the droplet, the droplet detection device including: a light emitting element that emits the detection light in a direction intersecting an advancing direction of the droplet discharged from the nozzle; a light receiving element that receives the detection light emitted from the light emitting element; and a pair of wall portions disposed facing each other with a spacing through which the droplet passes; wherein the pair of wall portions are arranged along a light path so that at least a part of the light path of the detection light from the light emitting element to the light receiving element passes between the pair of wall portions; and at least a part of the detection light is guided toward the light receiving element side while being reflected at respective opposing surfaces of the pair of wall portions in a region between the pair of wall portions in the light path.

According to such configuration, in the region where the pair of wall portions are arranged in the light path of the detection light, at least a part of the detection light is guided toward the light receiving element side while being reflected at the respective opposing surfaces of the pair of wall portions, and hence the light amount of the detection light received by the light receiving element can be ensured.

Thus, the droplet discharged from the nozzle of the head of the ink jet printer can be detected without using an expensive device such as a laser, and the droplet detection device in which the manufacturing cost is kept low compared to the conventional art can be provided.

Furthermore, the ink jet printer equipped with such liquid droplet detection device can be provided more inexpensively than the conventional art.

Each of the pair of wall portions of the droplet detection device of the present invention preferably has a predetermined height in an orthogonal direction orthogonal to an opposing direction of the pair of wall portions and a direction along the light path of the detection light; and a width in the opposing direction of the detection light emitted from the light emitting element is preferably equal to the spacing in the opposing direction of the pair of wall portions in at least some range in the orthogonal direction.

According to such configuration, in the droplet detection device of the present invention, a gap is not formed between the wall portion and the detection light in the opposing direction of the pair of wall portions in at least some range in the orthogonal direction with respect to both the opposing direction of the pair of wall portions and the direction along the light path between the pair of wall portions in a region sandwiched by the ends on the light emitting element side of the pair of wall portions, and hence a shade caused by the gap can be suppressed from forming in a range between the pair of wall portions.

The droplet detection device of the present invention thus can suppress the formation of a patch of sensitivity in the detection of the microdroplet in the range between the pair of wall portions, which is the detection range of the microdroplet, and detect the microdroplet at high accuracy, without including a collimating light source that uses an expensive device such as a laser. Therefore, the droplet detection device of the present invention can keep the manufacturing cost low compared to the conventional art.

Furthermore, in the pair of wall portions of the droplet detection device of the present invention, a slit that limits a width in the orthogonal direction of the detection light is preferably formed on an end side of the light emitting element side.

According to such configuration, the droplet detection device of the present invention can suppress the detection light emitted from the light emitting element from diffusing in the orthogonal direction while advancing toward the light receiving element side, and thus can suppress the detection light emitted from the light emitting element from diffusing in the orthogonal direction while advancing toward the light receiving element side and being reflected by some member, and thereafter being received by the light receiving element.

Therefore, the droplet detection device of the present invention can fill a range to carry out the detection of the microdroplet with the detection light of an even light amount by suppressing the loss of light amount by the diffusion of the detection light, and thus can suppress the formation of the patch of sensitivity in the detection of the microdroplet.

In other words, the droplet detection device of the present invention can detect the microdroplet at high accuracy.

Preferably, in the droplet detection device of the present invention, one end edge and another end edge in the orthogonal direction of the slit are respectively linearly extended in the opposing direction and arranged parallel to each other; and in a range between the pair of wall portions in the light path, the width in the opposing direction of the detection light is the same as the spacing between the pair of wall portions in an entire range in the orthogonal direction, and the width in the orthogonal direction of the detection light is the same as the width in the orthogonal direction of the slit in an entire range in the opposing direction.

According to such configuration, the droplet detection device of the present invention can suppress the formation of a patch of light amount in the detection light in both the opposing direction of the pair of wall portions and the orthogonal direction in the detection range of the microdroplet, and thus can suppress the formation of the patch of sensitivity in the detection of the microdroplet. In other words, the droplet detection device of the present invention can detect the microdroplet at high accuracy, and thus can accurately and easily carry out the detection of the microdroplet.

In the droplet detection device of the present invention, a length in the opposing direction of a light receivable region, where the light receiving element can receive the detection light is greater than or equal to the spacing of the pair of wall portions in the opposing direction.

According to such configuration, the droplet detection device of the present invention can detect an entire region of the detection light between the pair of wall portions in the opposing direction of the pair of wall portions. In other words, the droplet detection device of the present invention can detect the microdroplet in the entire range while ensuring a wide detection range of the microdroplet.

The droplet detection device of the present invention preferably includes a determination means that determines that the detection light is shielded by the droplet (microdroplet) when the light amount of the detection light received by the light receiving element becomes lower than a predetermined light amount by greater than or equal to a predetermined amount; and an abnormality determination means that causes the droplet (microdroplet) to be discharged in order from each of a plurality of nozzles configuring a nozzle row and determines presence or absence of clogging of each of the plurality of nozzles based on a determination result of the determination means.

According to such configuration, the presence or absence of clogging of each of the plurality of nozzles can be appropriately determined.

An ink jet printer of the present invention includes the droplet detection device, and a plurality of heads including a nozzle row in which nozzles for discharging the droplet (microdroplet) are lined in a direction along the light path; where the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

According to such configuration, the ink jet printer of the present invention is equipped with the droplet detection device capable of keeping the manufacturing cost lower than the conventional art, and thus can keep the manufacturing cost low compared to the conventional art.

The ink jet printer of the present invention can extend and expand the detection range of the microdroplet by the droplet detection device in the extending direction of the nozzle row of the head as the formation of the patch of sensitivity in the detection of the microdroplet can be suppressed and the detection light can be suppressed from being diffused thus losing light amount in the detection range of the microdroplet of the droplet detection device.

Therefore, the ink jet printer of the present invention can detect the microdroplet with respect to all the nozzles of the plurality of heads without moving the head with respect to the droplet detection device in the extending direction of the nozzle row.

Effect of the Invention

The droplet detection device and the ink jet printer of the present invention can keep the manufacturing cost low compared to the conventional art.

DESCRIPTION OF EMBODIMENT

Hereinafter, one embodiment of the present invention will be described using the drawings.

First, a configuration of an ink jet printer according to the present embodiment will be described.

Figure 1:
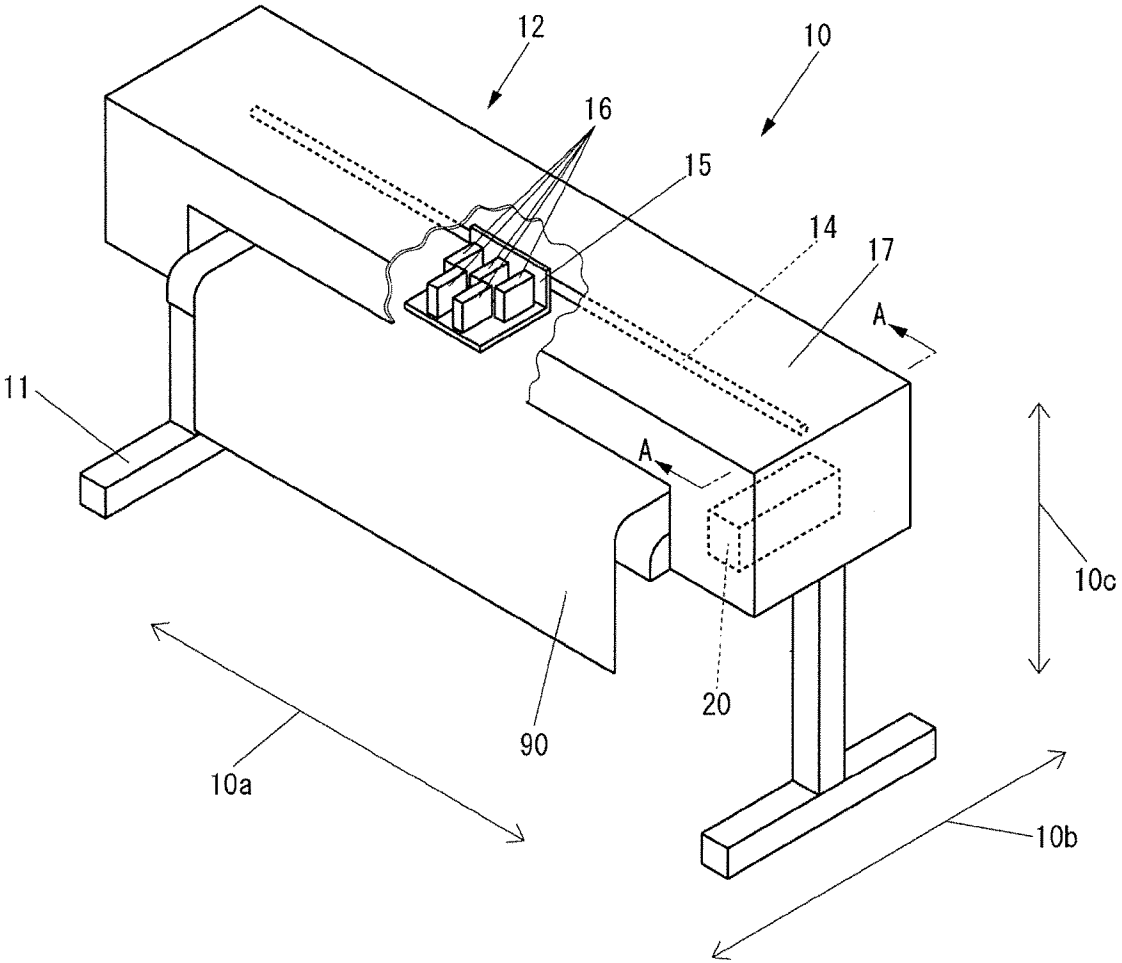
FIG. 1 is an outer appearance perspective view of an ink jet printer according to one embodiment of the present invention.

FIG. 1 is an outer appearance perspective view of an ink jet printer 10 according to the present embodiment.

As shown in FIG. 1, the ink jet printer 10 includes a leg section 11 installed on the floor, and a main body 12 being supported by the leg section 11 and extending in a direction of an arrow 10*a* (main scanning direction).

The main body 12 includes a medium transporting device (not shown) for transporting a medium 90 in a direction of an arrow 10*b* (sub-scanning direction) orthogonal to the direction of the arrow 10*a*, a guide rail 14 extending in the direction of the arrow 10*a*, a carriage 15 supported by the guide rail 14 and provided to be movable in the direction of the arrow 10*a* (main scanning direction), a plurality of heads 16 mounted on the carriage 15 to discharge ink toward the medium 90, a droplet detection device 20 that detects a microdroplet of an ink discharged from the head 16, a case 17 that covers the guide rail 14, the carriage 15, the heads 16, and the droplet detection device 20, and a control unit (not shown) that controls the operation of the entire ink jet printer 10.

The plurality of heads are arranged in a stagger arrangement. Therefore, the plurality of heads 16 arranged to line in the main scanning direction (direction of arrow 10*a*) on the carriage 15 are arranged such that the positions of the heads 16, 16 adjacent in the main scanning direction are shifted in the sub-scanning direction (direction of arrow 10*b*).

The droplet detection device 20 is disposed at a position where the medium 90 is not transported on one end side in the direction of the arrow 10*a* of the main body 12, that is, an evacuating position of the heads 16 in the interior of the main body 12.

The control unit includes, for example, a CPU (Central Processing Unit), a ROM (Read Only Memory) storing programs and various types of data in advance, and a RAM (Random Access Memory) used as a work region of the CPU.

The CPU executes the program stored in the ROM.

Figure 2:
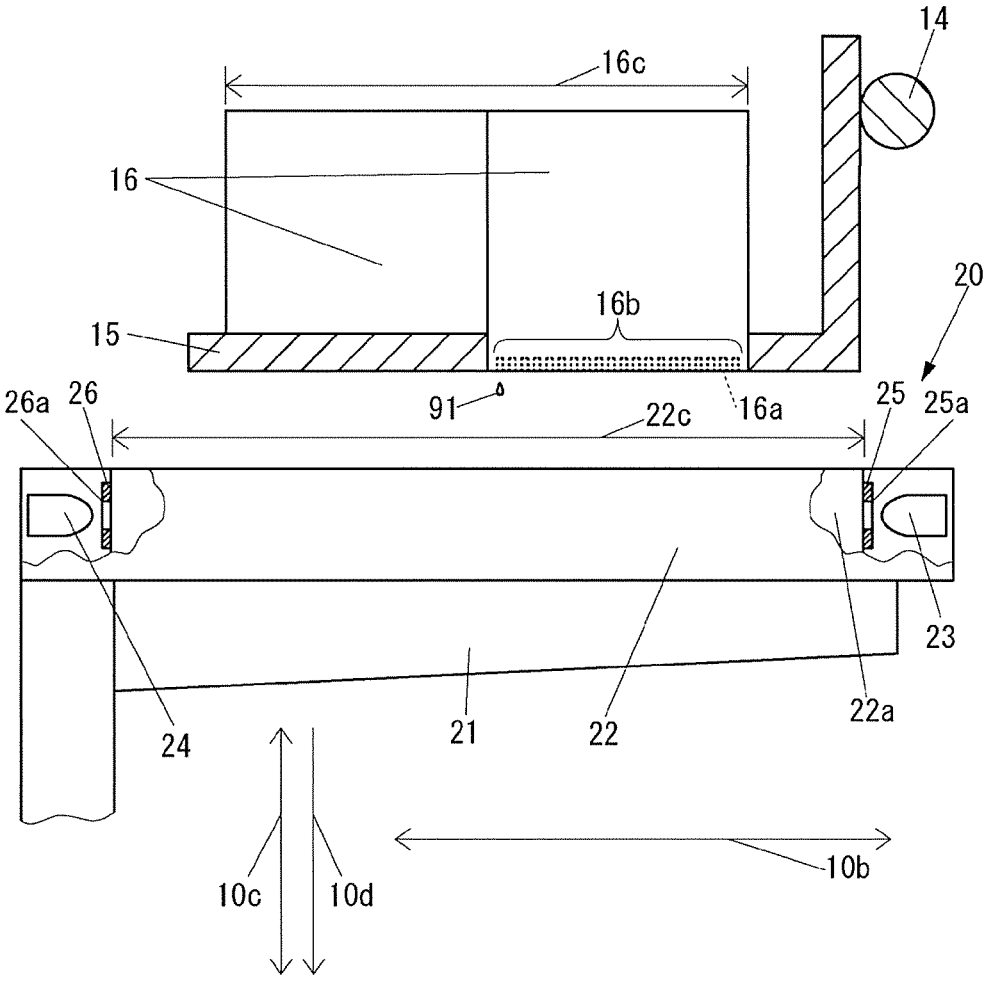
FIG. 2 shows one part of a cross-sectional view taken along A-A shown in FIG. 1.

FIG. 2 shows one part of a cross-sectional view taken along A-A shown in FIG. 1.

As shown in FIG. 2, the head 16 includes a nozzle row 16*b*, in which a plurality of nozzles 16*a* that discharge a microdroplet 91 of the ink are lined at a predetermined interval, on a surface facing the medium 90 (see FIG. 1), where the nozzle row 16*b* is arranged along the direction of the arrow 10*b* (sub-scanning direction) in the head 16.

Each of the nozzles 16*a* is arranged to discharge the ink toward the medium 90 located on a side (lower side) indicated with an arrow 10*d* in an up and down direction (direction of arrow 10*c*: orthogonal direction) orthogonal to both the main scanning direction (direction of arrow 10*a*: see FIG. 1) and the sub-scanning direction (direction of arrow 10*b*).

In FIG. 2, a case in which the position in the main scanning direction (direction of arrow 10*a*) of the carriage 15 including the plurality of heads is the position where the droplet detection device 20 is disposed on the lower side of one of the plurality of heads 16 arranged in the carriage 15 is shown.

Figure 3:
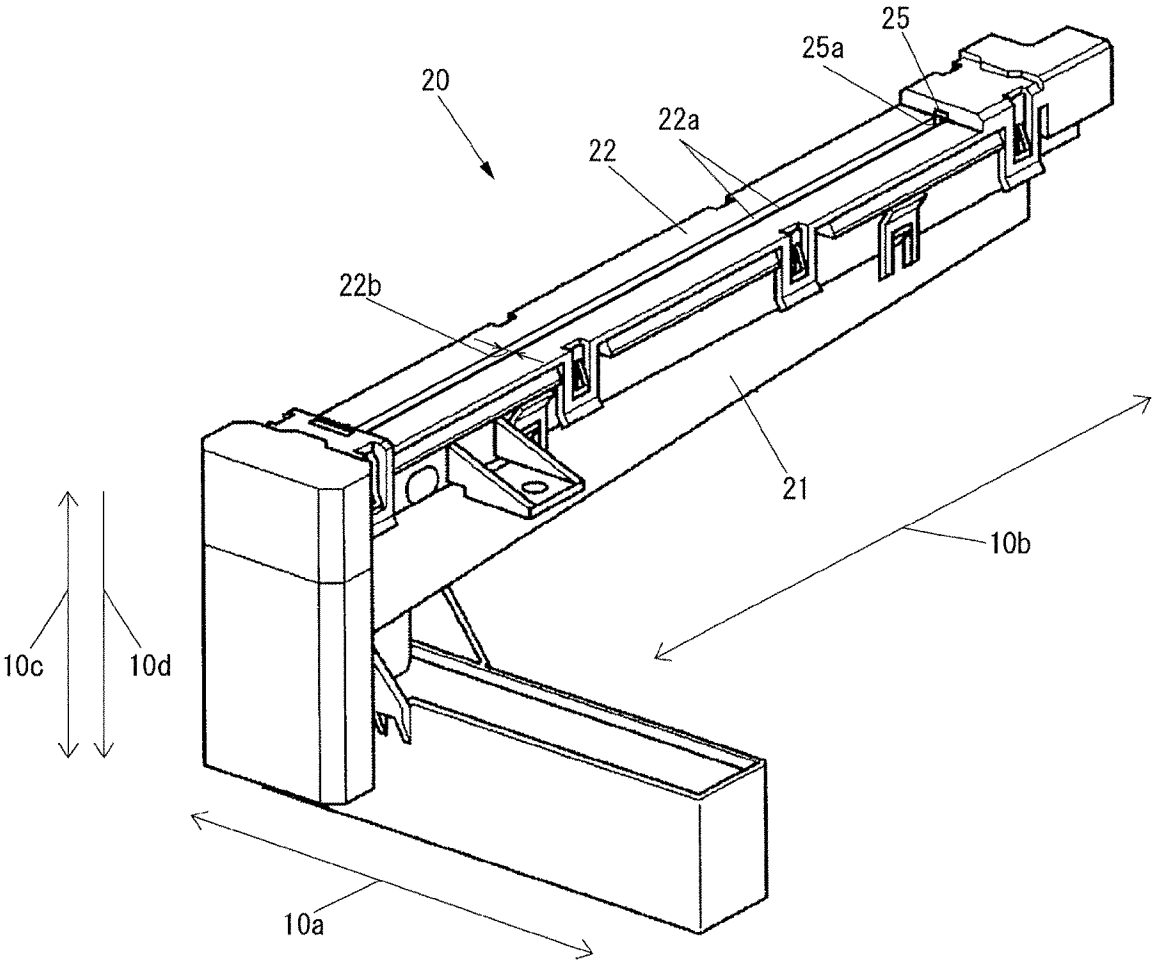
FIG. 3 is an outer appearance perspective view of a droplet detection device shown in FIG. 1.

FIG. 3 is an outer appearance perspective view of the droplet detection device 20.

Figure 4:
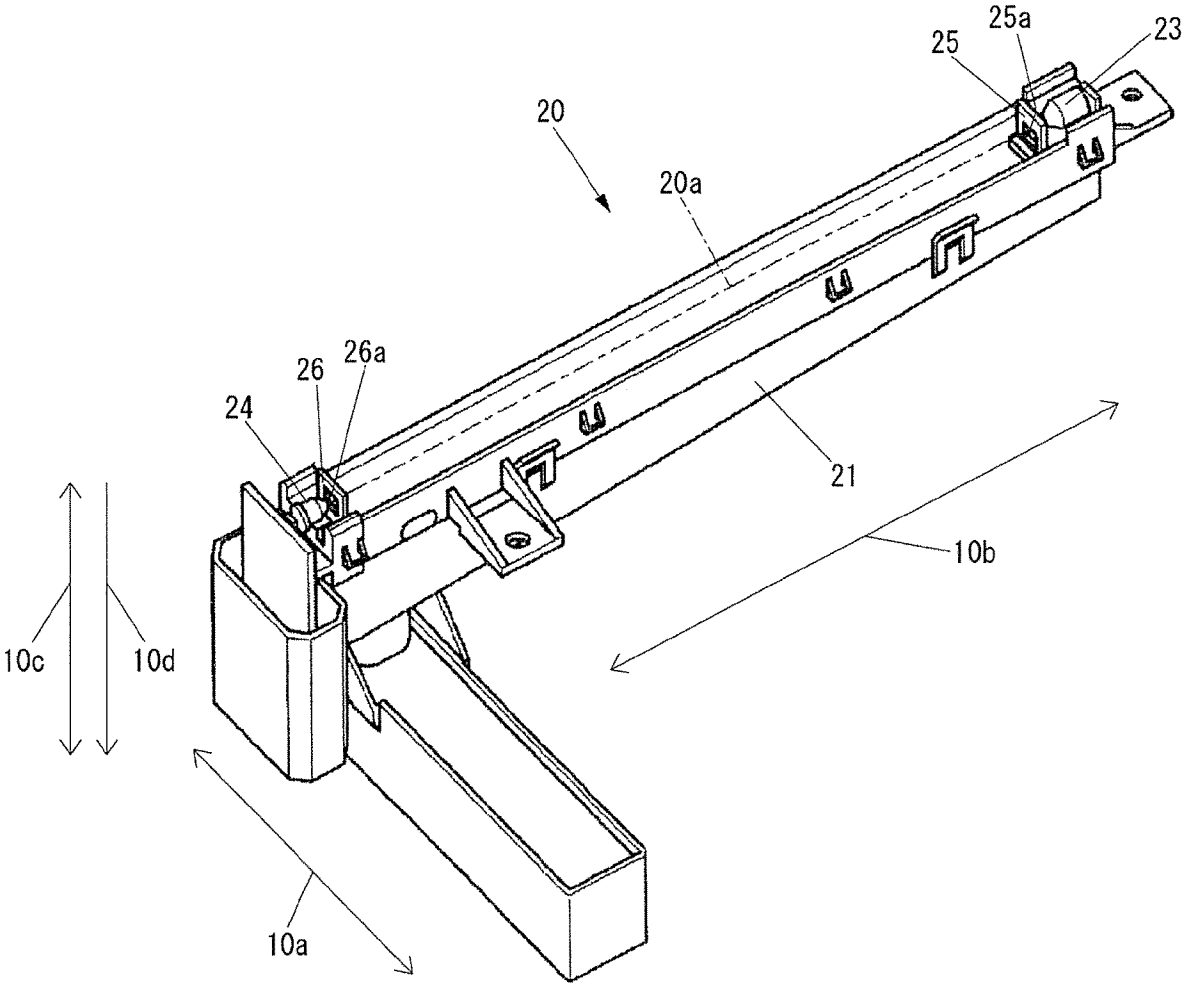
FIG. 4 is an outer appearance perspective view of the droplet detection device shown in FIG. 3 in which a cover is detached.

FIG. 4 is an outer appearance perspective view of the droplet detection device 20 in which a cover 22 is detached.

As shown in FIGS. 2 to 4, the droplet detection device 20 includes an ink adsorption case 21 that receives and adsorbs the microdroplet 91 discharged from the nozzle 16*a*, the cover 22 attached to the ink adsorption case 21, a light emitting element 23 (e.g., LED (Light Emitting Diode), etc.) that emits a detection light for detecting the microdroplet 91 in the direction of the arrow 10*b* intersecting an advancing direction of the microdroplet 91 indicated with the arrow 10*d*, a light receiving element 24 (e.g., PD (Photo Diode) etc.) that receives the detection light emitted from the light emitting element 23, a light width limiting member 25 formed with a slit 25*a* for limiting the width of the detection light emitted from the light emitting element 23, and a light width limiting member formed with a slit 26*a* for limiting the width of the detection light received by the light receiving element 24.

The droplet detection device 20 is a device that, when the microdroplet 91 is discharged from the nozzle 16*a* of the head 16, detects the microdroplet 91 when a light amount received by the light receiving element 24 becomes less than a scheduled amount by greater than or equal to a specific amount as a result of at least some of the detection light emitted from the light emitting element 23 being shielded by the microdroplet 91.

The cover 22 includes a pair of wall portions 22*a*, 22*a* disposed parallel to each other with a spacing in the main scanning direction (direction of arrow 10*a*).

The opposing surfaces of the wall portions 22*a*, 22*a* are flat surfaces lying along the sub-scanning direction (direction of arrow 10*b*), and the microdroplet 91 discharged from the nozzle 16*a* passes between the wall portions 22*a*, 22*a*.

The wall portion 22*a* does not need to be planar.

For example, the wall portion 22*a* may be in a curved line state, that is, a curved surface shape on a cross-section cut at a plane orthogonal to the direction of the arrow 10*b*.

However, when having a planar shape, the wall portion 22*a* can suppress patch of sensitivity in the direction of the arrow 10*c* in the detection of the microdroplet 91 in the droplet detection device 20.

When the wall portion 22*a* is in a curved surface shape, the width in the direction of the arrow 10*a* of a passing region of the microdroplet 91 between the pair of wall portions 22*a* is limited by a portion where the width between the pair of wall portions 22*a* is the narrowest in the direction of the arrow 10*a*.

Therefore, the pair of wall portions 22*a* preferably have a planar shape.

The wall portions 22*a*, 22*a* are symmetrically arranged with a light path 20*a* of the detection light emitted from the light emitting element 23 toward the light receiving element 24 in between, where a light diffused in opposing direction (main scanning direction: direction of arrow 10*a*) of the wall portions 22*a*, 22*a* of the detection light emitted from the light emitting element 23 is reflected by the wall portions 22*a*, 22*a*, so that the advancing direction of the reflected light is changed toward the light receiving element 24 side in the sub-scanning direction (direction of arrow 10*b*).

Thus, the light diffused in the main scanning direction can reach the light receiving element 24 side while repeating reflection at the wall portions 22*a*, 22*a*, and lowering in the light amount by the diffusion of the detection light can be suppressed by a light collecting effect from the reflection at the wall portions 22*a*, 22*a* in a region sandwiched by the wall portions 22*a*, 22*a* in the light path 20*a* of the detection light.

Thus, the light amount of the detection light received by the light receiving element 24 becomes greater than when the wall portions 22*a*, 22*a* are not arranged, whereby the detection sensitivity of the microdroplet 91, to be described later, can be enhanced without enhancing the performance of the light receiving element 24.

If the lowering in the light amount of the detection light is suppressed, a reachable distance (light receivable distance) of the detection light becomes long, and hence a separation distance of the light emitting element 23 and the light receiving element 24 can be extended. In this case, a range of the sub-scanning direction (direction of arrow 10*b*) that can be used for the detection of the microdroplet of the ink can be expanded.

The length in the direction of the arrow 10*a* (main scanning direction) of a light receivable region, where the light receiving element 24 can receive the detection light, is preferably greater than or equal to a spacing 22*b* (see FIG. 7) of the pair of wall portions 22*a*, 22*a* in the direction of the arrow 10*a*.

If the length of the light receivable region in the direction of the arrow 10*a* of the light receiving element 24 is greater than or equal to the spacing 22*b* of the pair of wall portions 22*a*, 22*a*, the entire range in the direction of the arrow 10*a* of the detection light passing between the pair of wall portions 22*a*, 22*a* can be used for the detection, and thus a wide detection range of the microdroplet 91 can be ensured.

When the length of the light receivable region by the light receiving element 24 in the direction of the arrow 10*a* is greater than or equal to the spacing 22*b* of the pair of wall portions 22*a*, 22*a*, the spacing 22*b* of the pair of wall portions 22*a*, 22*a* in the direction of the arrow 10*a* differs between at least some area and another area in the direction of the arrow 10*b* (sub-scanning direction), and when the spacing 22*b* in the direction of the arrow 10*a* is not the same over the entire length in the direction of the arrow 10*b*, the spacing 22*b* in the direction of the arrow 10*a* merely needs to be greater than or equal to a spacing of a shortest area.

The pair of wall portions 22*a*, 22*a* face each other while being parallel to each other. In other words, the spacing 22*b* in the opposing direction (direction of arrow 10*a*) of the pair of wall portions 22*a*, 22*a* is the same over the entire range in the direction of the arrow 10*b*.

The pair of wall portions 22*a* may not face each other while being parallel to each other. For example, when the pair of wall portions 22*a* both have a planar shape, the pair of wall portions 22*a* may not face each other while being parallel to each other as the extending directions of each of the pair of wall portions 22*a* are different.

Furthermore, the pair of wall portions 22*a* may not face each other while being parallel to each other if at least one of the pair of wall portions 22*a* is in a curved line state, that is, a curved surface shape on the cross-section cut at a plane orthogonal to the direction of the arrow 10*c*.

As shown in FIG. 2, a length 22*c* of the pair of wall portions 22*a*, 22*a* in the direction of the arrow 10*b* is greater than or equal to a width 16*c* in the direction of the arrow 10*b* of the row 16*b* of the nozzle 16*a* in the entire plurality of heads 16.

Figure 5:
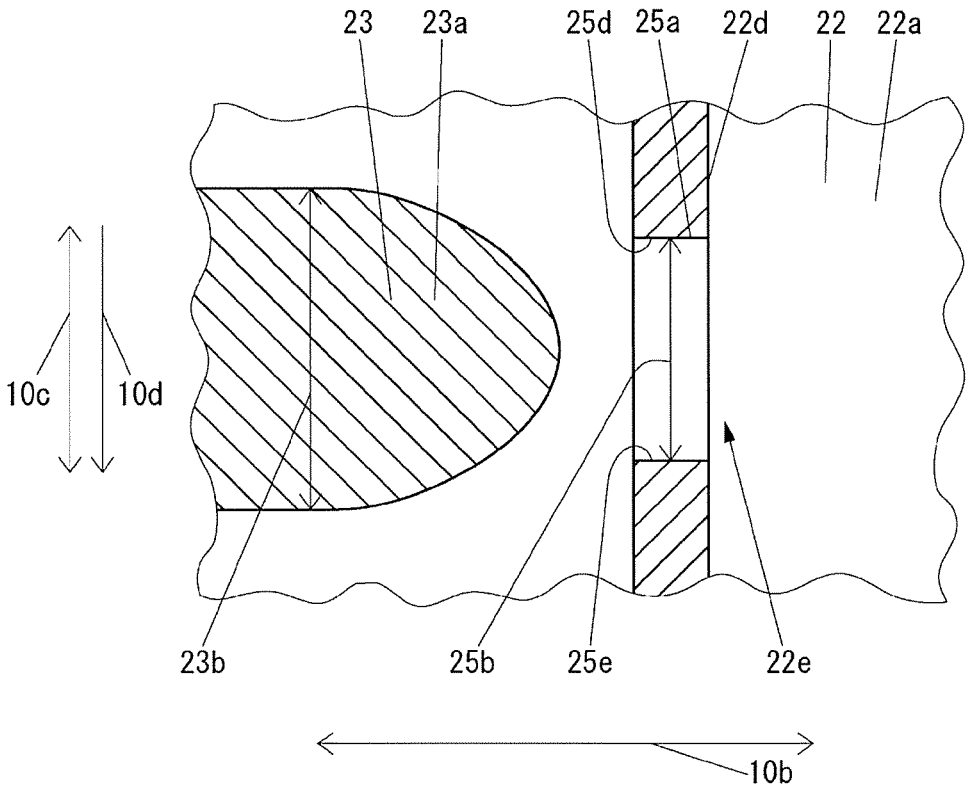
FIG. 5 is a cross-sectional view seen from a direction of an arrow 10*a* of one part of the droplet detection device shown in FIG. 3.

FIG. 5 is a view of some region on the light emitting element 23 side of the droplet detection device 20, where a cross-section cut at a plane along the arrow 10*b* is seen from the direction of the arrow 10*a*.

As shown in FIG. 5, when seen from the direction of the arrow 10*a*, the light emitting element 23 is arranged with the center in the direction of the arrow 10*c* of the light emitting element 23 coinciding with the center in the direction of the arrow 10*c* of the slit 25*a*, where the width 23*b* in the direction of the arrow 10*c* (up and down direction) of a light emitting portion 23*a* of the light emitting element 23 is wider than the width 25*b* of the slit 25*a* in the direction of the arrow 10*c*.

Thus, the detection light irradiated to a region 22*e* (hereinafter referred to as "end region") sandwiched with the ends 22*d* on the light emitting element 23 side of the pair of wall portions 22*a*, 22*a* through the slit 25*a* of the detection light emitted from the light emitting element 23 becomes the detection light having a width equal to the width 25*b* in the direction of the arrow 10*c* of the slit 25*a*.

In other words, the slit 25*a* limits the width of the detection light in the direction of the arrow 10*c* in the end region 22*e*.

The width 25*b* of the slit 25*a* in the direction of the arrow 10*c* is set so that the light amount of the detection light received by the light receiving element 24 becomes greater than or equal to a constant light amount, and in the embodiment, is set to an arbitrary width determined according to the light emitting intensity of the detection light emitted from the light emitting element 23.

In the embodiment, the light width limiting member 25 including the slit 25*a* is replaceable, where the light width limiting member 25 in which the width 25*b* of the slit 25*a* in the direction of the arrow 10*c* is narrow is adopted if the light emitting intensity of the detection light emitted from the light emitting element 23 is strong, and the light width limiting member 25 in which the width 25*b* of the slit 25*a* in the direction of the arrow 10*c* is wide is adopted if the light emitting intensity is weak, whereby the light amount of the detection light received by the light receiving element 24 can be adjusted to become greater than or equal to a constant light amount.

Figure 6:
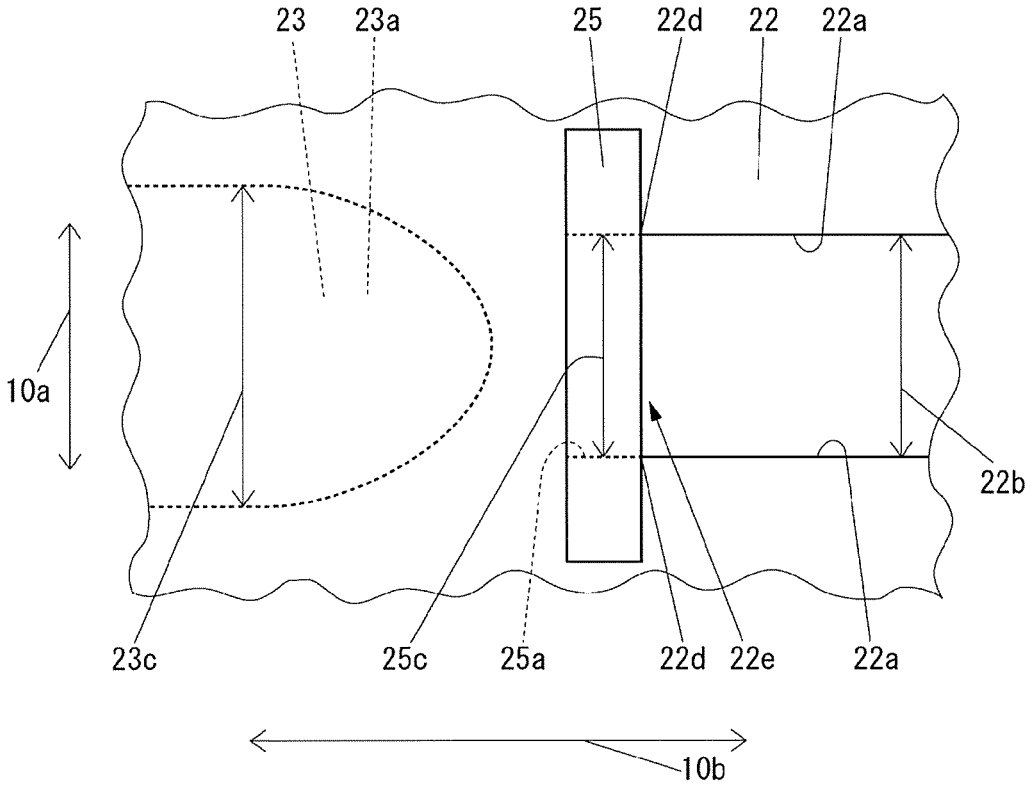
FIG. 6 is a plan view of one part of the droplet detection device shown in FIG. 3.

FIG. 6 is a view of some region on the light emitting element 23 side of the droplet detection device 20, where a cross-section cut at a plane along the arrow 10*a* is seen from the direction of the arrow 10*c*.

As shown in FIG. 6, when seen from the direction of the arrow 10*c*, the light emitting element 23 is arranged with the center in the direction of the arrow 10*a* of the light emitting element 23 coinciding with the center in the direction of the arrow 10*a* of the slit 25*a*.

The width 25*c* of the slit 25*a* in the direction of the arrow 10*a* is set to a width of greater than or equal to the spacing 22*b* of the pair of wall portions 22*a*, 22*a* in the direction of the arrow 10*a*, and the width 23*c* in the direction of the arrow 10*a* (horizontal direction) of the light emitting portion 23*a* of the light emitting element 23 is wider than the spacing 22*b* of the pair of wall portions 22*a*, 22*a* in the direction of the arrow 10*a*.

Thus, the detection light irradiated to the end region 22*e* of the pair of wall portions 22*a*, 22*a* through the slit 25*a* of the detection light emitted from the light emitting element 23 becomes the detection light having a width equal to the width 25*b* in the direction of the arrow 10*a* of the slit 25*a*.

Figure 7:
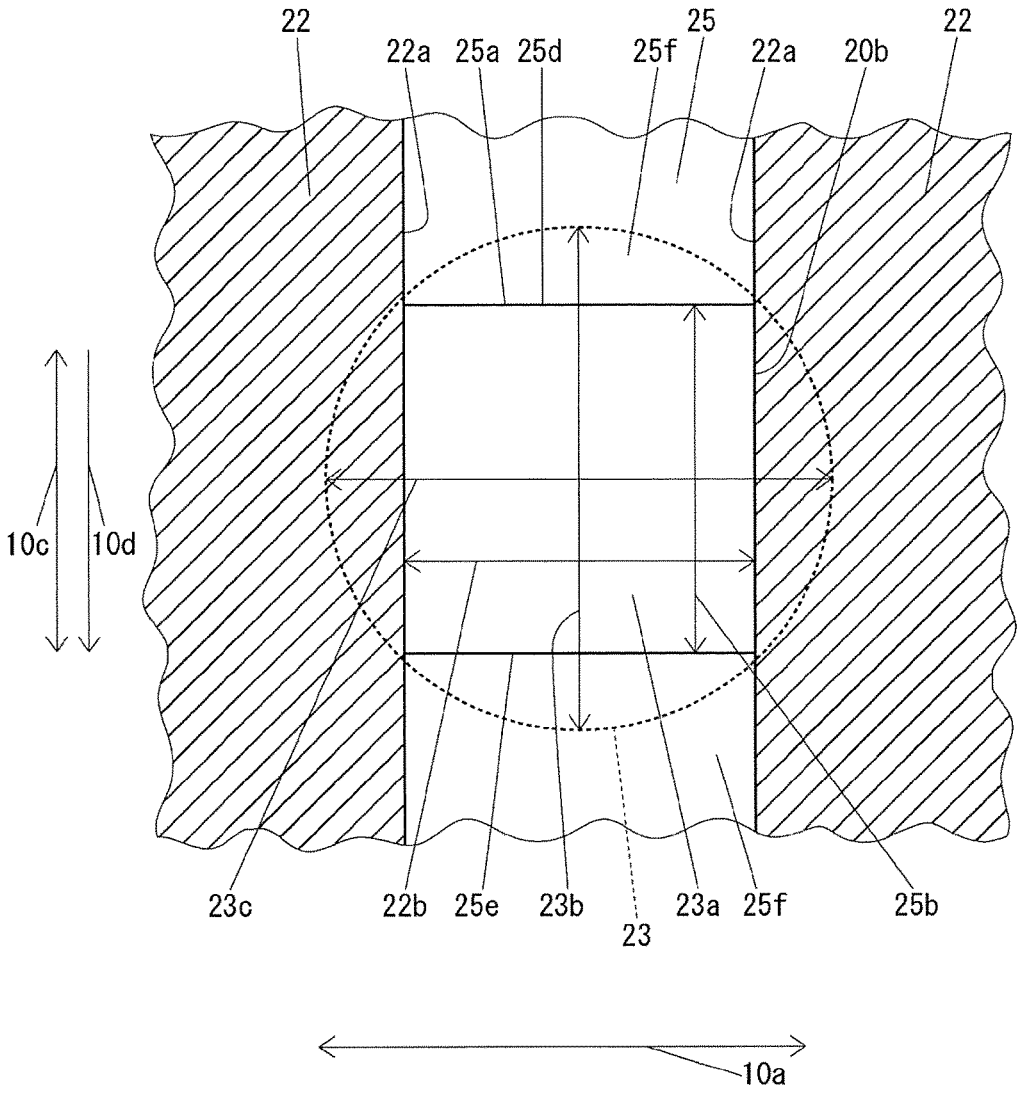
FIG. 7 is a cross-sectional view of one part of the droplet detection device shown in FIG. 3, and is a view in which a light width limiting member is seen from the light receiving element side.

FIG. 7 is a view of the pair of wall portions 22*a*, 22*a* of the droplet detection device 20, where the cross-section cut at a plane along the arrow 10*a* is viewed from the light receiving element 24 side, and is a view describing a relationship of the size of the slit 25*a* of the light width limiting member 25 and the outer diameter of the light emitting element 23 indicated with a broken line in the figure seen from the direction of the arrow 10*b*.

As shown in FIG. 7, the upper end 25*d* and the lower end 25*e* of the slit 25*a* are linearly extended in the direction of the arrow 10*a* (right and left direction in the figure) and located parallel to each other, and the width 25*b* in the direction of the arrow 10*c* of the slit 25*a* is the same width across the entire length in the direction of the arrow 10*a*.

Thus, the light width limiting member 25 defines the width in the direction of the arrow 10*c* of the detection light irradiated to the end region 22*e* of the pair of wall portions 22*a*, 22*a* through the slit 25*a* of the detection light emitted from the light emitting element 23 by regions 25*f*, 25*f* located on the upper side and the lower side with the slit 25*a* in between.

Furthermore, as described above, the spacing 22*b* in the direction of the arrow 10*a* between the pair of wall portions 22*a*, 22*a* is equal over the entire range in the direction of the arrow 10*c*.

When observed from the light receiving element 24 side, the light emitting portion 23*a* of the light emitting element 23 is greater than a rectangular hole 20*b* formed by the pair of wall portions 22*a* and the slit 25*a*, as shown in FIG. 7.

Therefore, the detection light emitted from the light emitting element 23 has the width in the direction of the arrow 10*a* in the end region 22*e* equal to the spacing 22*b* over the entire range in the direction of the arrow 10*c*.

Furthermore, the detection light emitted from the light emitting element has the width in the direction of the arrow 10*c* in the end region 22*e* equal to the width 25*b* of the slit 25*a* in the direction of the arrow 10*c* over the entire range in the direction of the arrow 10*a*.

Next, an operation of the ink jet printer 10 will be described.

When print data is transmitted from a computer such as a PC (Personal Computer) (not shown), the control unit of the ink jet printer 10 discharges ink toward the medium 90 based on the transmitted print data to print an image on the medium 90.

Specifically, the control unit discharges the microdroplet 91 (see FIG. 2) of the ink from the head 16 toward the medium 90 while changing the relative position of the head 16 with respect to the medium 90 in the main scanning direction (direction of arrow 10*a*) and the sub-scanning direction (direction of arrow 10*b*).

When changing the position in the main scanning direction indicated with the arrow 10*a* of the relative position of the head 16 with respect to the medium 90, the control unit moves the carriage 15 along the guide rail 14 in the main scanning direction indicated with the arrow 10*a*.

When changing the position in the sub-scanning direction indicated with the arrow 10*b* of the relative position of the head 16 with respect to the medium 90, the control unit causes the medium transportation device to move the medium 90 in the sub-scanning direction indicated with the arrow 10*b*.

The control unit of the ink jet printer 10 executes an examination on whether or not the microdroplet 91 can be appropriately discharged from the nozzle 16*a* of the head 16 at a specific time point such as a time point a specific number of printing is completed, a time point an instruction is given from a user, and the like.

Specifically, the control unit brings the row 16*b* of the nozzle 16*a* of the head 16 to be examined and the region between the pair of wall portions 22*a*, 22*a* of the droplet detection device 20 to face each other in the direction of the arrow 10*c* by moving the carriage 15 along the guide rail 14 in the main scanning direction indicated with the arrow 10*a*.

The control unit then discharges the microdroplet 91 from the nozzle 16*a* to be examined while emitting the detection light from the light emitting element 23 with each one of the nozzles 16*a* of the head 16 to be examined serving as the examination target in order.

Whether or not the microdroplet 91 can be appropriately discharged from the nozzle 16*a* to be examined is determined by measuring the change in the light amount of the detection light received by the light receiving element 24 while discharging the microdroplet 91 from the nozzle 16*a* to be examined.

When the light amount of the detection light received by the light receiving element 24 is reduced by greater than or equal to a specific extent while discharging the microdroplet 91 from the nozzle 16*a* to be examined, the control unit determines that the microdroplet 91 is detected by the droplet detection device 20, that is, the microdroplet 91 is appropriately discharged from the nozzle 16*a* to be examined.

Specifically, the control unit determines presence/absence of nozzle clogging by a light shielding rate (light amount) of the detection light received by the light receiving element 24 of when a plurality of microdroplets 91 continuously discharged to determine the presence/absence of clogging of the nozzle 16*a* are all located within a spot of the detection light received by the light receiving element 24. That is, determination is made that the nozzle 16*a* is not clogged when the light shielding rate (light amount) of the detection light received by the light receiving element 24 is greater than or equal to a threshold value, which is a predetermined light shielding rate, and determination is made that the nozzle 16*a* is clogged when the light shielding rate is smaller than the threshold value.

As described above, the outer diameter of the light emitting element 23 indicated with a broken line in the figure is greater than the spacing 22*b* between the pair of wall portions 22*a*, 22*a* (see FIG. 7).

Thus, in the droplet detection device 20, the detection light emitted from the light emitting element 23 is tightly irradiated over the entire length of the spacing 22*b* in the direction of the arrow 10*a* of the pair of wall portions 22*a*, 22*a* in the end region 22*e* between the ends 22*d*, 22*d* on the light emitting element 23 side of the pair of wall portions 22*a*, 22*a*.

Thus, a gap does is not formed between the wall portions 22*a*, 22*a* and the detection light in the direction of the arrow 10*a*, and hence a shade caused by the gap can be suppressed from being formed between the pair of wall portions 22*a*, 22*a*.

Figure 8:
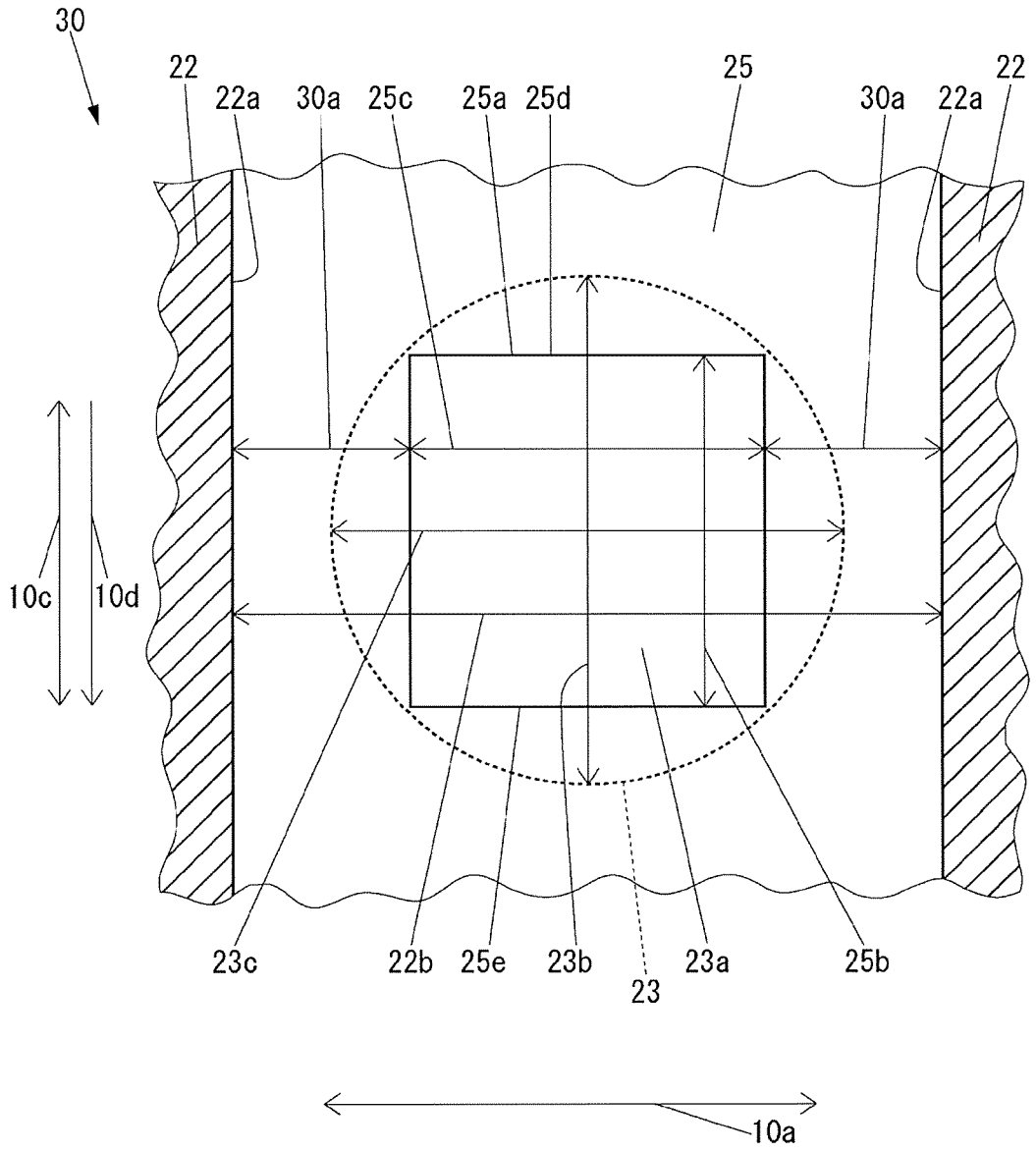
FIG. 8 is a cross-sectional view of one part of a droplet detection device serving as a comparative example of the droplet detection device shown in FIG. 3, and is a view in which the light width limiting member is seen from the light receiving element side.

FIG. 8 is a view of the pair of wall portions 22*a*, 22*a* of a droplet detection device 30 according to a comparative example, where the cross-section cut at a plane along the arrow 10*a* is viewed from the light receiving element 24 side, and is a view describing the light width limiting member 25 in which the width 25*c* of the slit 25*a* in the direction of the arrow 10*a* is smaller than the spacing 22*b* of the pair of wall portions 22*a*, 22*a*.

In the droplet detection device 30 shown in FIG. 8, the spacing 22*b* of the pair of wall portions 22*a*, 22*a* is made wide compared to the droplet detection device 20 shown in FIG. 7.

Specifically, in the droplet detection device 30, the width 25*c* of the slit 25*a* in the direction of the arrow 10*a* is smaller than the spacing 22*b* of the pair of wall portions 22*a*, 22*a* in the direction of the arrow 10*a*.

Therefore, the spacing 22*b* of the pair of wall portions 22*a*, 22*a* is wider than the width of the detection light in the direction of the arrow 10*a* in the end region 22*e*.

Thus, a shade arising from a region (gap 30*a*, 30*a*) between the slit 25*a* in the light width limiting member 25 and the wall portions 22*a*, 22*a* is formed on both sides of the slit 25*a* in the direction of the arrow 10*a* in the detection light emitted from the light emitting element 23 and then irradiated to the spacing 22*b* of the wall portions 22*a*, 22*a* through the slit 25*a*.

In other words, in the droplet detection device 30, the gap 30*a* is formed between the wall portion 22*a* and the detection light in the direction of the arrow 10*a* in the entire range in the direction of the arrow 10*c* in the end region 22*e* (see FIG. 6) between the pair of wall portions 22*a*, 22*a*.

Figure 9:
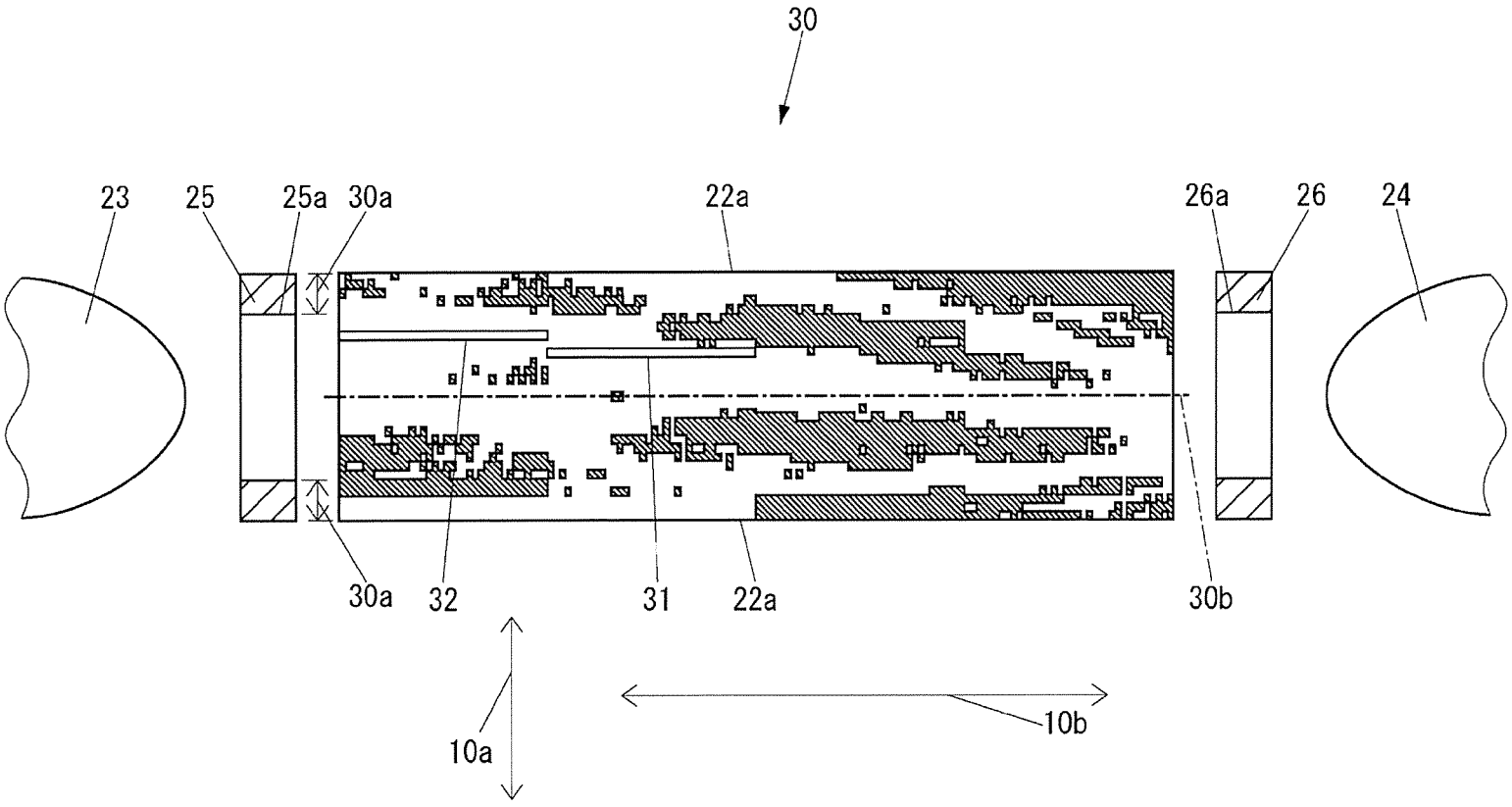
FIG. 9 is a view showing one example of a map of sensitivity in the droplet detection device shown in FIG. 8.

FIG. 9 is a view showing one example of a map of sensitivity in the droplet detection device 30.

In FIG. 9, a range indicated with hatching represents the shade formed as a result of the gap 30*a* in a light path 20*a* (see FIG. 4) of the detection light, and is a range where the sensitivity is poor and that cannot be used for the detection of the microdroplet 91 (see FIG. 2). In other words, in the droplet detection device 30, patch (shade) of sensitivity in the detection of the microdroplet 91 is formed in the range between the pair of wall portions 22*a*, 22*a*, which is the detection range of the microdroplet 91.

If the shade is on the lower side of a nozzle hole to be examined, even if the microdroplet 91 is normally discharged from the nozzle hole, the microdroplet 91 that passed the shade portion does not greatly change the light amount of the detection light received by the light receiving element 24, and thus determination may be made as "microdroplet cannot be detected".

Thus, the range where the shade is formed is a range that cannot be used for the detection of the microdroplet 91 (see FIG. 2). In other words, the droplet detection device 30 is a device in which the accurate detection of the microdroplet 91 is difficult. The patch of sensitivity in the detection of the microdroplet 91 in the range between the pair of wall portions 22*a*, 22*a*, which is the detection range of the microdroplet 91, is formed.

In the range between the pair of wall portions 22*a*, 22*a*, the reason the range of poor sensitivity is not symmetrically formed with the center line 30*b* as an axis in the direction of the arrow 10*a* includes error in positions at the time of assembly of each of the light emitting element 23, the light receiving element 24, the light width limiting member 25, and the light width limiting member 26 and the pair of wall portions 22*a*, 22*a*, and the design position, and the like.

In the situation shown in FIG. 9, to use the range where the sensitivity is satisfactory and the shade is not formed, for example, the position of the carriage 15 in the direction of the arrow 10*a* needs to be controlled by the control unit to discharge the microdroplet 91 to a range 31 or a range 32 where the sensitivity is satisfactory and the shade is not formed.

Therefore, in order to detect the microdroplet 91, high accuracy control by the control unit is required for position alignment of the carriage 15 in the direction of the arrow 10*a*, and a time for position alignment of the carriage 15 in the direction of the arrow 10*a* is required.

Furthermore, since the range where the sensitivity is poor and the shade is formed spreads with aging degradation of the light emitting element 23, readjustment for newly specifying a range where the sensitivity is satisfactory and the shade is not formed is required after elapse of time of a certain extent.

Figure 10:
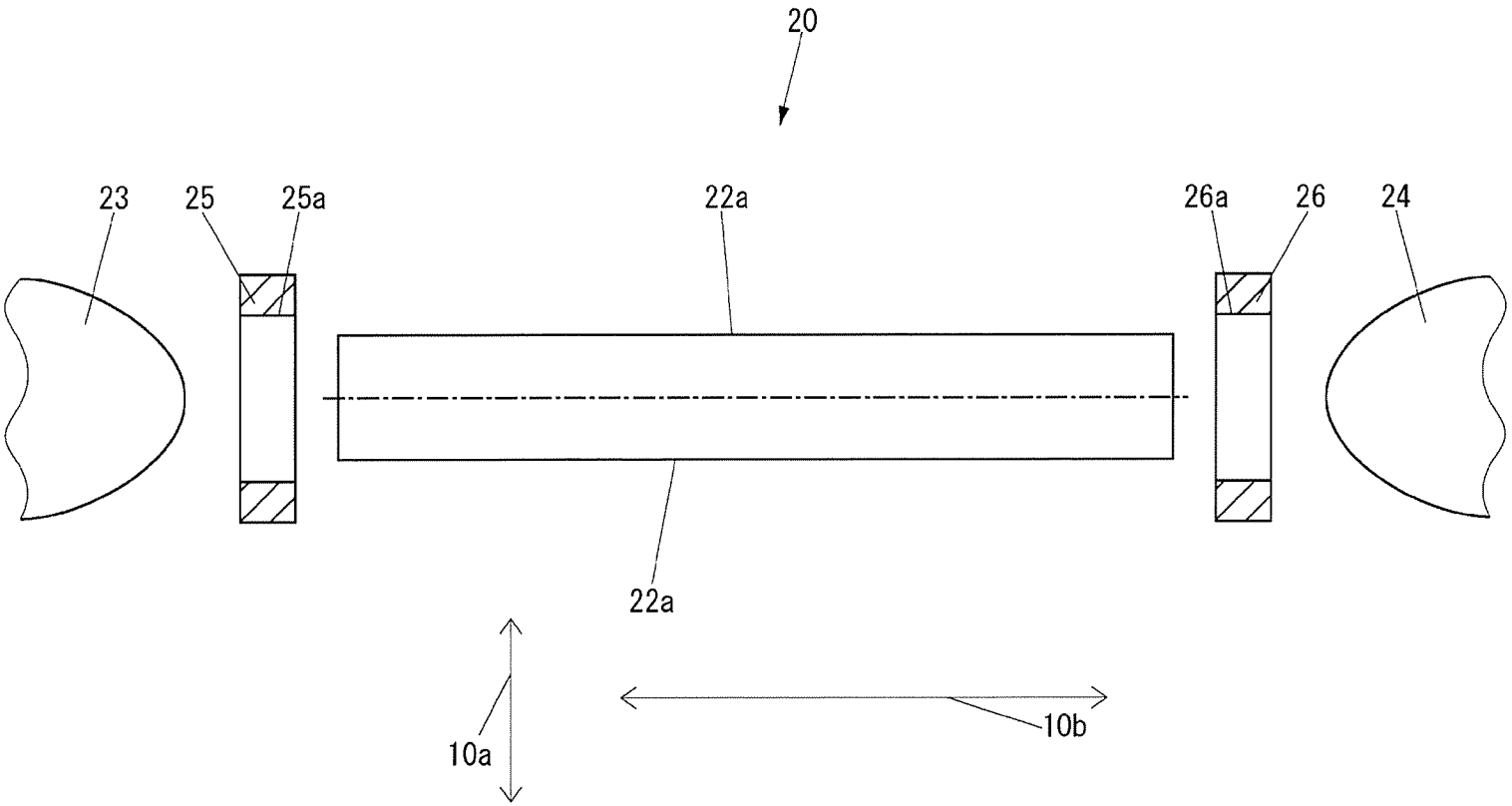
FIG. 10 is a view showing one example of a map of sensitivity in the droplet detection device shown in FIG. 3.

On the contrary, in the droplet detection device 20 according to the embodiment, the shade can be suppressed from being formed in the range between the pair of wall portions 22*a*, as shown in FIG. 10.

FIG. 10 is a view showing one example of a map of sensitivity in the droplet detection device 20.

In the droplet detection device 20 of FIG. 10, a range in which the sensitivity is poor and cannot be used for the detection of the microdroplet 91 (see FIG. 2) does not exist.

In other words, in the droplet detection device 20, a patch of sensitivity in the detection of the microdroplet 91 in the range between the pair of wall portions 22*a*, which is the detection range of the microdroplet 91 (see FIG. 2), is not formed.

In the situation shown in FIG. 10, the detection of the microdroplet 91 can be carried out accurately and easily with satisfactory sensitivity even if any range in the range between the pair of wall portions 22*a*, 22*a* is used, and thus the position of the carriage 15 in the direction of the arrow 10*a* does not need to be controlled at high accuracy compared to the situation shown in FIG. 9.

The droplet detection device 20 can suppress shade from forming in the range between the pair of wall portions 22*a*, 22*a*, and thus even if the collimating light source that uses an expensive device such as a laser is not arranged, the formation of the patch of sensitivity in the detection of the microdroplet 91 in the range between the pair of wall portions 22*a*, 22*a*, which is the detection range of the microdroplet 91, can be suppressed, and the microdroplet 91 can be accurately and easily detected at high accuracy. Therefore, the droplet detection device 20 and the ink jet printer 10 equipped with the droplet detection device 20 can keep the manufacturing cost low compared to the conventional droplet detection device and the conventional ink jet printer.

The droplet detection device 20 is formed with the slit 25*a* for limiting the width of the detection light in the end region 22*e* in the direction of the arrow 10*c*, and thus the detection light emitted from the light emitting element 23 can be suppressed from diffusing in the direction of the arrow 10*c* while advancing toward the light receiving element 24 side.

Thus, the droplet detection device 20 can suppress the detection light emitted from the light emitting element 23 from diffusing in the direction of the arrow 10*c* while advancing toward the light receiving element 24 side, being reflected by some member such as the head 16, and the like, and thereafter being received by the light receiving element 24.

Therefore, the droplet detection device 20 can suppress the formation of the patch of sensitivity in the detection of the microdroplet 91. In other words, the droplet detection device 20 can detect the microdroplet 91 at high accuracy.

The droplet detection device 20 can suppress the formation of the patch in the light amount of the detection light both in the direction of the arrow 10*a* and in the direction of the arrow 10*c* in the detection range of the microdroplet 91 since the width of the detection light in the direction of the arrow 10*a* in the end region 22*e* is equal to the spacing 22*b* in the entire range in the direction of the arrow 10*c*, and the width of the detection light in the direction of the arrow 10*c* in the end region 22*e* is equal to the width 25*b* of the slit 25*a* in the direction of the arrow 10*c* in the entire range in the direction of the arrow 10*a*.

Therefore, the droplet detection device 20 can suppress the formation of the patch of sensitivity in the detection of the microdroplet 91. In other words, the droplet detection device 20 can detect the microdroplet 91 at high accuracy.

The droplet detection device 20 may not have a configuration in which the width of the detection light in the direction of the arrow 10*a* in the end region 22*e* is equal to the spacing 22*b* in the entire range in the direction of the arrow 10*c* as long as the configuration is such that the gap is not formed between the wall portion 22*a* and the detection light in the direction of the arrow 10*a* in at least some range in the direction of the arrow 10*c* in the end region 22*e*.

Furthermore, the droplet detection device 20 may not have a configuration in which the width of the detection light in the direction of the arrow 10*c* in the end region 22*e* is equal to the width 25*b* of the slit 25*a* in the direction of the arrow 10*c* in the entire range in the direction of the arrow 10*a* as long as the configuration is such that the gap is not formed between the wall portion 22*a* and the detection light in the direction of the arrow 10*a* in at least some range in the direction of the arrow 10*c* in the end region 22*e*.

Figure 11A:
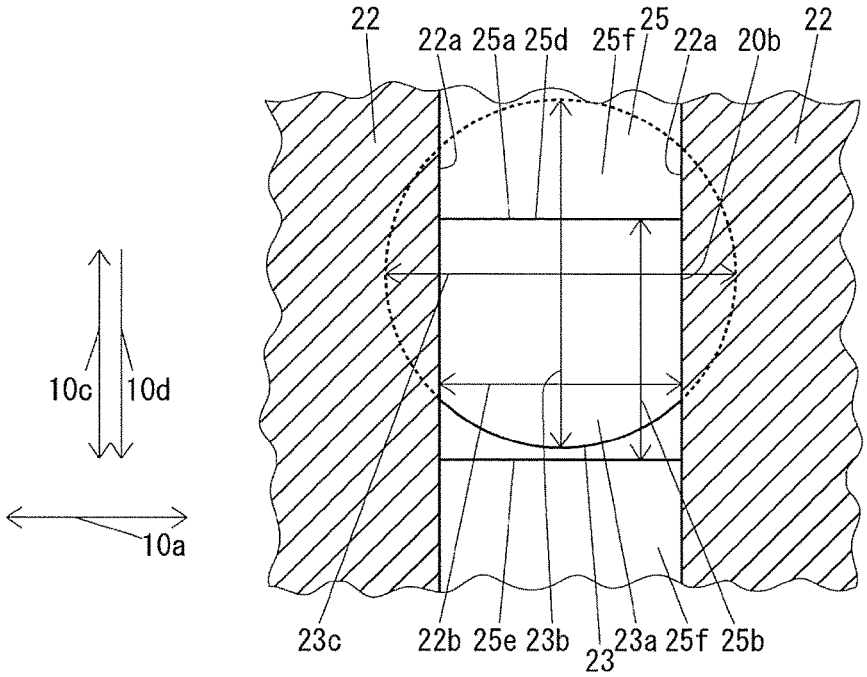
FIG. 11A is a cross-sectional view of one part of the droplet detection device shown in FIG. 3 in which a light width limiting member is seen from the light receiving element side, and is a view showing an example different from the example shown in FIG. 7.

For example, as shown in FIG. 11A, the droplet detection device 20 may be disposed with the light emitting element 23 deviated in a direction (upper side in the figure) opposite the direction of the arrow 10*d* with respect to the slit 25*a*.

In the case of the configuration shown in FIG. 11A, in the droplet detection device 20, the width of the detection light in the direction of the arrow 10*a* in the end region 22*e* is different from the spacing 22*b* at one part in the direction of the arrow 10*c* (narrower than the spacing 22*b*), and the width of the detection light in the direction of the arrow 10*c* in the end region 22*e* is also different from the width 25*b* of the slit 25*a* in the direction of the arrow 10*c* in the entire range in the direction of the arrow 10*a*.

The droplet detection device 20 may not have a configuration in which the width 25*b* in the direction of the arrow 10*c* between two portions 25*f* for limiting the width of the detection light in the end region 22*e* in the direction of the arrow 10*c* of the slit 25*a* is equal in the entire range in the direction of the arrow 10*a* as long as the configuration is such that the gap is not formed between the wall portion 22*a* and the detection light in the direction of the arrow 10*a* in at least some range in the direction of the arrow 10*c* in the end region 22*e*.

Figure 11B:
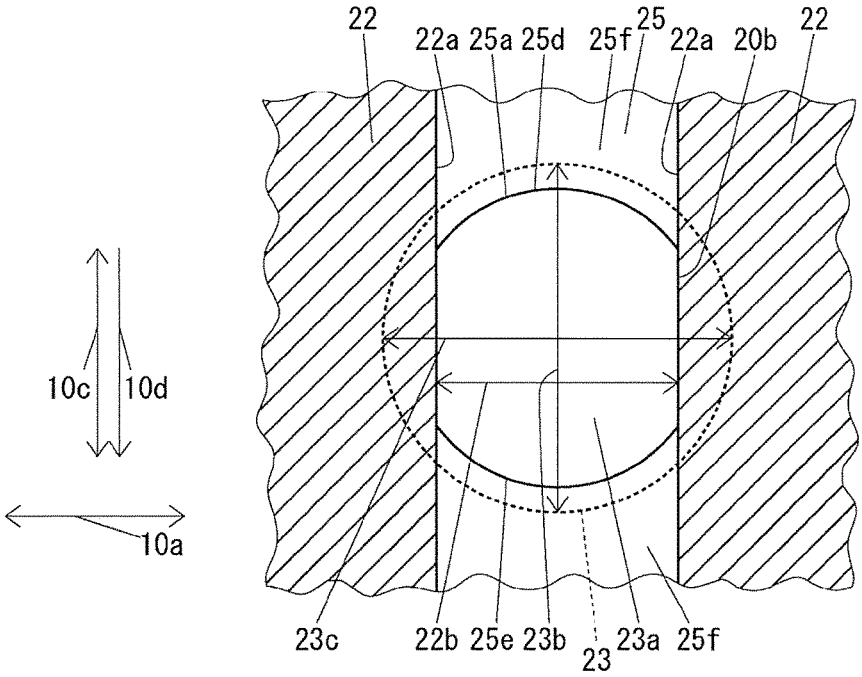
FIG. 11B is a cross-sectional view of one part of the droplet detection device shown in FIG. 3 in which the light width limiting member is seen from the light receiving element, and is a view showing an example different from the examples shown in FIG. 7 and FIG. 11A.

For example, as shown in FIG. 11B, the droplet detection device 20 may have the shapes of the upper end 25*d* and the lower end 25*e* of the slit 25*a* bent. In the case of the configuration shown in FIG. 11B, in the droplet detection device 20, the width of the detection light in the direction of the arrow 10*a* in the end region 22*e* is different from the spacing 22*b* at one part in the direction of the arrow 10*c*.

The ink jet printer 10 can extend and expand the detection range of the microdroplet 91 by the droplet detection device 20 in the extending direction indicated with the arrow 10*b* of the row 16*b* of the nozzles 16*a* of the head 16 since the formation of the patch of sensitivity in the detection of the microdroplet 91 can be suppressed and the detection light can be suppressed from being diffused thus losing light amount in the detection range of the microdroplet 91 of the droplet detection device 20.

Therefore, even if the head 16 is not moved in the direction of the arrow 10*b* with respect to the droplet detection device 20 although the positions in the direction of the arrow 10*b* of the row 16*b* of the nozzles 16*a* of at least two heads 16 of the plurality of heads 16 are shifted from each other, the ink jet printer 10 can detect the microdroplet 91 with respect to all the nozzles 16*a* of the plurality of heads 16.

The ink jet printer 10 may be arranged with at least two positions in the direction of the arrow 10*b* of the plurality of heads 16 shifted from each other by an array other than the stagger arrangement. Furthermore, the ink jet printer 10 may have the positions in the direction of the arrow 10*b* of all the heads 16 equal.

The invention claimed is:

1. A droplet detection device that detects a droplet discharged from a nozzle of a head of an ink jet printer based on presence or absence of shielding of a detection light by the droplet, the droplet detection device comprising:

a light emitting element that emits the detection light in a direction intersecting an advancing direction of the droplet discharged from the nozzle;

a light receiving element that receives the detection light emitted from the light emitting element; and a pair of wall portions disposed facing each other with a spacing through which the droplet passes; wherein the pair of wall portions are arranged along a light path so that at least a part of the light path of the detection light from the light emitting element to the light receiving element passes between the pair of wall portions; and at least a part of the detection light is guided toward the light receiving element side while being reflected at respective opposing surfaces of the pair of wall portions in a region between the pair of wall portions in the light path.

2. The droplet detection device as set forth in claim 1, wherein the pair of wall portions each has a predetermined height in an orthogonal direction orthogonal to an opposing direction of the pair of wall portions and a direction along the light path of the detection light; and a width in the opposing direction of the detection light is equal to the spacing in the opposing direction of the pair of wall portions in at least some range in the orthogonal direction.

3. The droplet detection device as set forth in claim 2, wherein a length of a light receivable region, where the light receiving element receives the detection light, the length being in the opposing direction of the pair of wall portions, is greater than or equal to the spacing of the pair of wall portions in the opposing direction.

4. An ink jet printer comprising:

the droplet detection device as set forth in claim 3; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

5. An ink jet printer comprising:

the droplet detection device as set forth in claim 2; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

6. The droplet detection device as set forth in claim 1, wherein a slit that limits a width of the detection light in an orthogonal direction orthogonal to an opposing direction of the pair of wall portions and a direction along the light path of the detection light is formed between the pair of wall portions.

7. The droplet detection device as set forth in claim 6, wherein one end edge and another end edge in the orthogonal direction of the slit are respectively linearly extended in the opposing direction and arranged parallel to each other; and in a range between the pair of wall portions in the light path, the width in the opposing direction of the detection light is the same as the spacing between the pair of wall portions in an entire range in the orthogonal direction, and the width in the orthogonal direction of the detection light is the same as the width in the orthogonal direction of the slit in an entire range in the opposing direction.

8. The droplet detection device as set forth in claim 7, wherein a length of a light receivable region, where the light receiving element receives the detection light, the length being in the opposing direction of the pair of wall portions, is greater than or equal to the spacing of the pair of wall portions in the opposing direction.

9. An ink jet printer comprising:

the droplet detection device as set forth in claim 8; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

10. An ink jet printer comprising:

the droplet detection device as set forth in claim 7; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

11. The droplet detection device as set forth in claim 6, wherein a length of a light receivable region, where the light receiving element receives the detection light, the length being in the opposing direction of the pair of wall portions, is greater than or equal to the spacing of the pair of wall portions in the opposing direction.

12. An ink jet printer comprising:

the droplet detection device as set forth in claim 11; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

13. An ink jet printer comprising:

the droplet detection device as set forth in claim 6; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

14. The droplet detection device as set forth in claim 1, wherein a length of a light receivable region, where the light receiving element receives the detection light, the length being in an opposing direction of the pair of wall portions, is greater than or equal to the spacing of the pair of wall portions in the opposing direction.

15. An ink jet printer comprising:

the droplet detection device as set forth in claim 14; and a plurality of heads including a nozzle row in which nozzles for discharging the droplet are lined in the direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

16. An ink jet printer comprising:

the droplet detection device as set forth in claim 1; and a plurality of heads including a nozzle row in which nozzles for discharging the droplet are lined in a direction along the light path; wherein the plurality of heads are configured by a head located on one side in the direction along the light path, and a head located on the other side; and a length in the direction along the light path of the pair of wall portions is longer than a length in the direction along the light path in a range where the nozzle row of the head located on one side and the nozzle row of the head located on the other side are located.

* * * * *